US007708901B2

(12) United States Patent
Böse et al.

(10) Patent No.: US 7,708,901 B2
(45) Date of Patent: May 4, 2010

(54) MAGNETORHEOLOGICAL MATERIALS HAVING MAGNETIC AND NON-MAGNETIC INORGANIC SUPPLEMENTS AND USE THEREOF

(75) Inventors: Holger Böse, Würzburg (DE); Alexandra-Maria Trendler, Würzburg (DE)

(73) Assignee: Fraunhofer-Gesellschaft zur Forderung der Angewandten Forschung e.V., Munich (DE)

( * ) Notice: Subject to any disclaimer, the term of this patent is extended or adjusted under 35 U.S.C. 154(b) by 73 days.

(21) Appl. No.: 11/574,390

(22) PCT Filed: Aug. 25, 2005

(86) PCT No.: PCT/EP2005/009194

§ 371 (c)(1),
(2), (4) Date: Feb. 27, 2007

(87) PCT Pub. No.: WO2006/024456

PCT Pub. Date: Mar. 9, 2006

(65) Prior Publication Data

US 2007/0210274 A1 Sep. 13, 2007

(30) Foreign Application Priority Data

Aug. 27, 2004 (DE) ..... 10 2004 041 651

(51) Int. Cl.
*H01F 1/44* (2006.01)

(52) U.S. Cl. ..... 252/62.52; 252/62.54; 252/62.53

(58) Field of Classification Search ..... 252/62.52
See application file for complete search history.

(56) References Cited

U.S. PATENT DOCUMENTS

| | | | | |
|---|---|---|---|---|
| 2,575,360 | A | | 11/1951 | Rabinow |
| 2,938,183 | A | * | 5/1960 | Dillon, Jr. ..... 336/218 |
| 3,425,666 | A | * | 2/1969 | Lindquist et al. ..... 252/62.58 |
| 3,855,691 | A | * | 12/1974 | Deschamps et al. ..... 29/608 |
| 5,019,537 | A | | 5/1991 | Kato et al. |
| 5,525,249 | A | | 6/1996 | Kordonsky et al. |
| 5,549,837 | A | * | 8/1996 | Ginder et al. ..... 252/62.52 |
| 5,578,238 | A | | 11/1996 | Weiss et al. |
| 5,645,752 | A | | 7/1997 | Weiss et al. |
| 5,667,715 | A | | 9/1997 | Foister |
| 5,771,013 | A | | 6/1998 | Fey |
| 5,900,184 | A | | 5/1999 | Weiss et al. |
| 5,905,112 | A | | 5/1999 | Hellermann |
| 5,971,835 | A | | 10/1999 | Kordonski et al. |
| 5,985,168 | A | | 11/1999 | Phule |
| 6,027,664 | A | * | 2/2000 | Weiss et al. ..... 252/62.52 |
| 6,123,633 | A | | 9/2000 | Guenther et al. |
| 6,132,633 | A | | 10/2000 | Carlson |
| 6,203,717 | B1 | | 3/2001 | Munoz et al. |
| 6,395,193 | B1 | | 5/2002 | Kintz et al. |
| 6,399,193 | B1 | | 6/2002 | Ellison |
| 6,451,219 | B1 | | 9/2002 | Iyengar et al. |
| 6,592,772 | B2 | | 7/2003 | Foister et al. |
| 6,599,439 | B2 | | 7/2003 | Iyengar et al. |
| 6,610,404 | B2 | | 8/2003 | Starkovich et al. |
| 7,354,528 | B2 | | 4/2008 | Cheng et al. |
| 7,393,463 | B2 | | 7/2008 | Ulicny et al. |
| 7,419,616 | B2 | | 9/2008 | Ulicny et al. |
| 2002/0066881 | A1 | | 6/2002 | Koppe |
| 2003/0035955 | A1 | | 2/2003 | Yadav |
| 2004/0105980 | A1 | | 6/2004 | Sudarshan et al. |
| 2004/0126565 | A1 | | 7/2004 | Naganathan et al. |
| 2005/0116194 | A1 | | 6/2005 | Fuchs et al. |
| 2007/0252104 | A1 | | 11/2007 | Böse |
| 2008/0318045 | A1 | | 12/2008 | Böse |
| 2009/0039309 | A1 | | 2/2009 | Böse |

FOREIGN PATENT DOCUMENTS

| | | | |
|---|---|---|---|
| CA | 2059356 | | 7/1992 |
| DE | 40 30 780 | A1 | 4/1991 |
| DE | 41 01 869 | A1 | 7/1992 |
| DE | 38 90 400 | C2 | 2/1994 |
| DE | 196 14 140 | C1 | 5/1997 |
| DE | 196 13 194 | A1 | 10/1997 |
| DE | 197 25 971 | A1 | 12/1998 |
| DE | 100 24 439 | A1 | 12/2001 |
| EP | 0 418 807 | B1 | 2/1995 |
| EP | 0 784 163 | A1 | 7/1997 |
| EP | 1 283 530 | A2 | 2/2003 |
| EP | 1 283 531 | A2 | 2/2003 |
| EP | 1 372 162 | A1 | 12/2003 |
| WO | WO 93/21644 | A1 | 10/1993 |
| WO | WO 94/10693 | A1 | 5/1994 |
| WO | WO 94/10694 | A1 | 5/1994 |

(Continued)

OTHER PUBLICATIONS

English translation of International Preliminary Report on Patentability for International Patent Application No. PCT/EP2005/009194.

(Continued)

*Primary Examiner*—C. Melissa Koslow
(74) *Attorney, Agent, or Firm*—Leydig, Voit & Mayer, Ltd.

(57) ABSTRACT

The invention relates to magnetorheological materials comprising at least one non-magnetisable carrier medium and magnetisable particles contained therein, in addition a combination of magnetic and non-magnetic inorganic materials and/or composite particles thereof being contained.

29 Claims, 4 Drawing Sheets

FOREIGN PATENT DOCUMENTS

| | | | |
|---|---|---|---|
| WO | WO 01/61713 | A1 | 8/2001 |
| WO | WO 01/84568 | A2 | 11/2001 |
| WO | WO 02/45102 | A1 | 6/2002 |
| WO | WO 03/021611 | A1 | 3/2003 |
| WO | WO 03/025056 | A1 | 3/2003 |

OTHER PUBLICATIONS

"Proceedings of the 5th International Conference on Electro-Rheological Fluids, Magneto-Rheological Suspensions and Associated Technology", Sheffield, UK, Jun. 1995, Bullough, W.R. Ed., World Scientific Publishing Co. Pte. Ltd., Singapore (1995) pp. vii-xiii.

Chin et al., "Rheological Properties and Dispersion Stability of Magnetorheological (MR) Suspensions", Rheol Acta, 40: pp. 211-219 (2001).

Davis, L.C., "Model of Magnetorheological Elastomers", Journal of Applied Physics, 85(6): pp. 3348-3351 (1999).

Ginder et al., "Magnetorheological Elastomers: Properties and Applications", SPIE, 3675: pp. 131-138 (1999).

Jolly et al., "The Magnetoviscoelastic Response of Elastomer Composites Consisting of Ferrous Particles Embeddded in a Polymer Matrix", Journal of Intelligent Material Systems and Structures, vol. 7, pp. 613-622 (Nov. 1996).

Jolly et al., "A Model of the Behaviour of Magnetorheological Materials", Smart Mater. Struct., 5: pp. 607-614 (1996).

Jolly et al., "Properties and Applications of Commercial Magnetorheological Fluids", SPIE, vol. 3327, pp. 262-275 (1998).

Shen et al., "Experimental Research and Modeling of Magnetorheological Elastomers", Journal of Intelligent Material Systems and Structures, vol. 15, pp. 27-35 (Jan. 2004).

Florian, Zschunke, "Aktoren auf Basis des magnetorheologisten Effekts" [online], Jun. 20, 2005, p. 21, line 1-26, line 5.

* cited by examiner

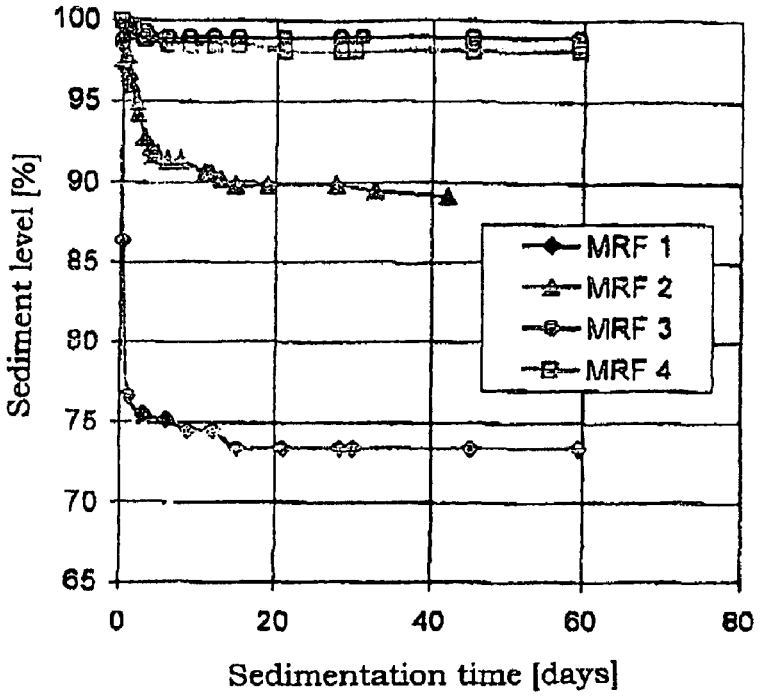
Figure 1. Sedimentation course at 25°C as a function of time for
- MRF 1 without supplement,
- MRF 2 with supplement of lithium grease NLGI 2,
- MRF 3 with supplement according to the invention comprising mica flakes coated with nanoscale magnetite,
- MRF 4 with supplement according to the invention of hydrophobic bentonite and nanoscale magnetite.

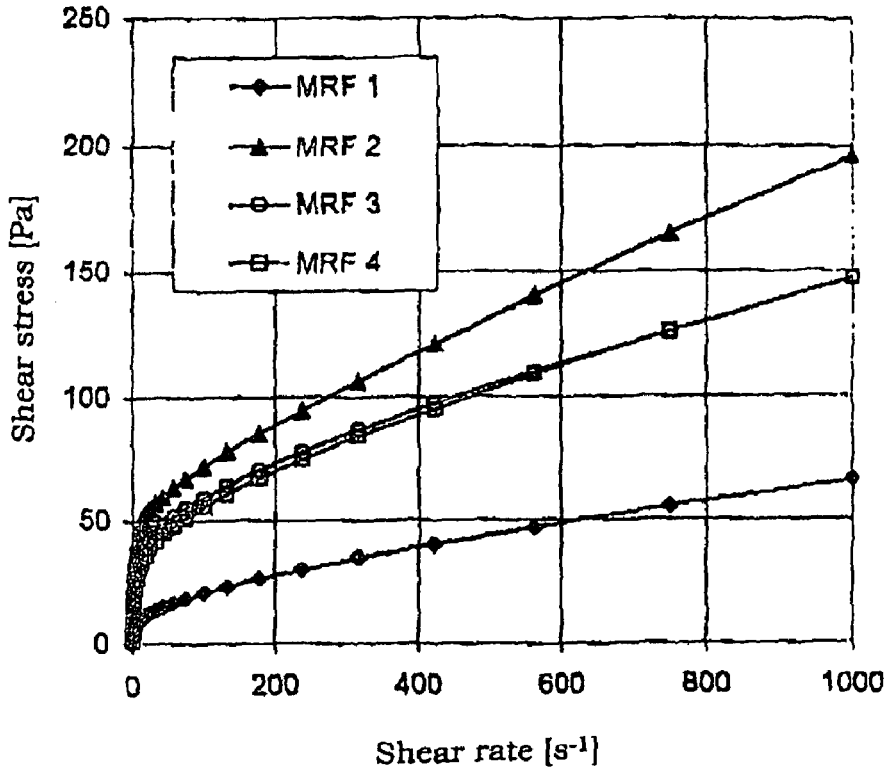

Figure 2. Dependency of the shear stress upon the shear rate (flow curves at 25°C) without an applied magnetic field for

- MRF 1 without supplement,
- MRF 2 with supplement of lithium grease NLGI 2,
- MRF 3 with supplement according to the invention comprising mica flakes coated with nanoscale magnetite,
- MRF 4 with supplement according to the invention of hydrophobic bentonite and nanoscale magnetite.

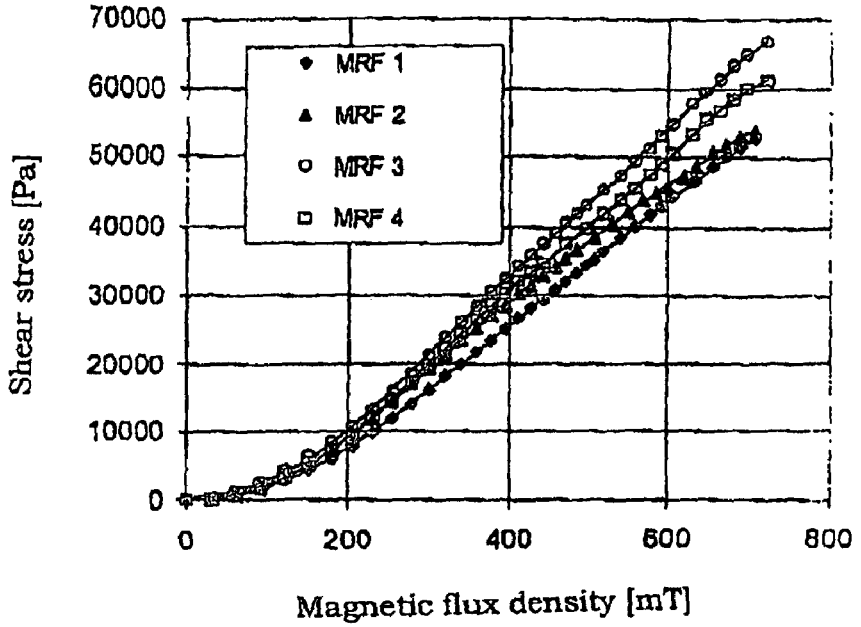

Figure 3. Dependency of the shear stress upon the magnetic flux density at a shear rate of 100 $s^{-1}$ and 25°C for

- MRF 1 without supplement,
- MRF 2 with supplement of lithium grease NLGI 2,
- MRF 3 with supplement according to the invention comprising mica flakes coated with nanoscale magnetite,
- MRF 4 with supplement according to the invention of hydrophobic bentonite and nanoscale magnetite.

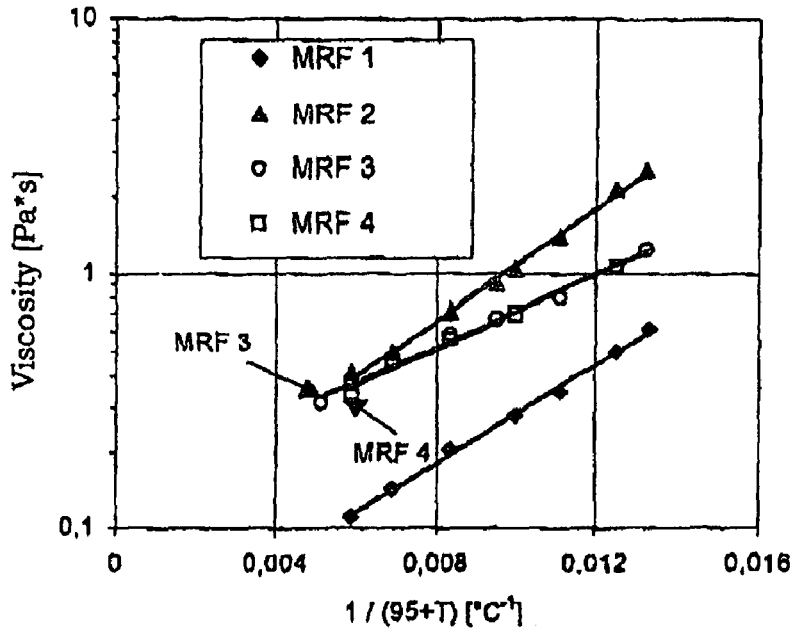

Figure 4. Dependency of the dynamic viscosity as a function of the temperature (Vogel-Cameron plotting) at a shear rate of 100 $s^{-1}$ for

- MRF 1 without supplement,
- MRF 2 with supplement of lithium grease NLGI 2,
- MRF 3 with supplement according to the invention comprising mica flakes coated with nanoscale magnetite
- MRF 4 with supplement according to the invention of hydrophobic bentonite and nanoscale magnetite.

MAGNETORHEOLOGICAL MATERIALS HAVING MAGNETIC AND NON-MAGNETIC INORGANIC SUPPLEMENTS AND USE THEREOF

This application is the U.S. national phase of International Patent Application PCT/EP2005/009194, filed on Aug. 25, 2005, which claims priority to German Patent Application No. 10 2004 041 651.6, filed Aug. 27, 2004, all of which are hereby incorporated by reference.

The present invention relates to magnetorheological materials having magnetic and non-magnetic inorganic supplements, in particular to magnetorheological fluids (MRFs) having magnetic and non-magnetic inorganic supplements, and use thereof.

MRFs are materials which change their flow behaviour under the effect of an external magnetic field. Like their electrorheological analogues, the so-called electrorheological fluids (ERFs), they generally comprise non-colloidal suspensions made of particles which can be polarised in a magnetic or electrical field in a carrier fluid which possibly contains further supplements.

The fundamental principles of MRFs and first devices for using the magnetorheological effect are attributable to Jacob Rabinow in 1948 (Rabinow, J., Magnetic Fluid Clutch, National Bureau of Standards Technical News Bulletin 33(4), 54-60, 1948; U.S. Pat. No. 2,575,360). After an initially great stir, the interest in MRFs firstly ebbed and then experienced a renaissance from the middle of the nineties (Bullough, W. A. (Editor), Proceedings of the 5th International Conference on Electro-rheological Fluids, Magneto-Rheological Suspensions and Associated Technology (1.), Singapore, New Jersey, London, Hong Kong: World Scientific Publishing, 1996). In the meantime, numerous magnetorheological fluids and systems are commercially available, such as e.g. MRF brakes and also various vibration and shock absorbers (Mark R. Jolly, Jonathan W. Bender and J. David Carlson, Properties and Applications of Commercial Magnetorheological Fluids, SPIE 5th Annual Int. Symposium on Smart Structures and Materials, San Diego, Calif., Mar. 15, 1998). In the following, a few special properties of MRFs and their ability to be influenced are described.

MRFs are generally non-colloidal suspensions of magnetisable particles of approx. 1 micrometre up to 1 millimetre in size in a carrier fluid. In order to stabilise the particles relative to sedimentation and to improve the application properties, the MRF can contain in addition additives, such as e.g. dispersion agents and supplements which have a thickening effect. Without an external magnetic field, the particles are distributed ideally homogeneously and isotropically so that the MRF has a low basic viscosity in the non-magnetic space. When applying an external magnetic field, the magnetisable particles arrange themselves in chain-like structures parallel to the magnetic field lines. As a result, the flow capacity of the suspension is restricted, which makes itself noticeable macroscopically as an increase in viscosity. The viscosity thereby increases as a rule monotically with the applied magnetic field strength.

The changes in the flow behaviour of the MRFs depend upon the concentration and type of the magnetisable particles, upon their shape, size and size distribution; however also upon the properties of the carrier fluid, the additional additives, the applied field, temperature and other factors. The mutual interrelationships of all these parameters are exceptionally complex so that individual improvements in an MRF with respect to a special target size have constantly been the subject of tests and optimisation efforts. The development of MRFs with a low tendency to sedimentation is thereby a research priority.

Like all suspensions, MRFs are also inclined to demix on the basis of the different masses of their components in gravitation and centrifugal fields, i.e. previously homogeneous mixed phases separate in time into a pure fluid phase and into a solids-rich sediment. This effect is undesired since it primarily concerns the magnetisable particles and hence impairs the mode of operation of the MRFs and the systems constructed therewith. One development aim is therefore to provide MRFs with the smallest possible tendency to sedimentation. A further aim, which is directly connected thereto, is as easy as possible redispersibility. Since in fact sedimentation can never be entirely precluded, the demixed MRFs should be produced at least such that they can be converted easily back into a homogeneous mixture, i.e. with minimum expenditure of force. Furthermore, it is desirable for the materials to have as small a basic viscosity as possible in the absence of an external magnetic field.

According to the state of the art, MRFs generally contain supplements in order to stabilise the magnetisable particles against sedimentation. Diverse organic additives are known for this purpose. In addition, also inorganic supplements are mentioned for stabilising the MRFs. There are included herein oxidic particles, such as silicon dioxide, in particular as nanoparticles in the form of pyrogenic silicic acid, and also laminar silicates which are organically modified in some cases.

U.S. Pat. No. 5,985,168 describes the stabilisation of the magnetisable particles in the MRF by a combination of small particles, in particular silicon dioxide, and a bridging polymer. Both together form a gel which envelopes the magnetisable particles as a layer.

In U.S. Pat. No. 6,592,772 B2, an MRF is represented, the carrier fluid of which comprises various components and in which differently organically modified laminar silicates, so-called "organoclays" are contained in order to stabilise the magnetisable particles, said laminar silicates being coordinated respectively with the specific properties of the components of the carrier fluid.

In U.S. Pat. No. 6,451,219 B1 and U.S. Pat. No. 6,599,439 B2, unmodified pyrogenic silicic acid with a high specific surface is used in order to stabilise the magnetisable particles in the MRF. Optionally, an ethoxylated amine can be added.

U.S. Pat. No. 5,645,752 mentions colloidal metal oxides, such as e.g. pyrogenic salicic acid which was made hydrophobic by surface modification and also hydrophilic silicone oligomers and copolymer organosilicone oligomers, for stabilising the MRFs.

In U.S. Pat. No. 6,203,717 B1, an MRF is described which contains a hydrophobic organoclay for stabilising the magnetisable particles, said organoclay being obtained from bentonite. A low hardness of the sediment is established for the MRF.

U.S. Pat. No. 6,132,633 describes an MRF based on water as carrier fluid using bentonites and hectorites.

In EP 1 283 530 A2 and EP 1 283 531 A2, the use of pyrogenic silicic acid is indicated for stabilising an MRF with bimodal particle size distribution based on a hydrocarbon-based carrier fluid, in the last patent document with the addition of a molybdenum-amine complex. Pyrogenic silicic acid is also used in WO 03/021611.

In WO 93/21644 A1, the composition of an MRF is described, which contains, in addition to the magnetisable soft magnetic particles, also hard magnetic particles, preferably iron oxide or chromium dioxide with particle sizes between 0.1 and 1 μm. The hard magnetic particles are adsorbed on the surface of the soft magnetic particles, It may be said in summary that the state of the art offers a multiplicity of individual detailed solutions for improving special material and operational parameters of magnetorheological materials, in particular MRFs, however a total solution with respect to demixing, redispersibility, basic viscosity and temperature stability is still awaited.

Starting herefrom, it is the object to the present invention to propose new magnetorheological materials, in particular MRFs, which simultaneously fulfil in particular the five subsequent requirements:

high stability against demixing, easy redispersibility, low basic viscosity in the non-magnetic space, high shear stress in the magnetic field, high stability against temperature variations.

This object is achieved by a magnetorheological material comprising at least one non-magnetisable carrier medium and magnetisable particles contained therein, wherein the material additionally contains a combination of magnetic and non-magnetic inorganic materials and/or composite particles thereof. Advantageous developments of magnetorheological materials, in particular MRFs, which are produced in this way are described herein. Furthermore, the magnetorheological materials of the invention can be used in adaptive shock and vibration dampers, controllable brakes, clutches and also in sports or training appliances; for surface treatment of workpieces, or to generate and/or display haptic information, such as characters, computer-simulated objects, sensor signals or images; for simulation of viscous, elastic and/or visco-elastic properties or the consistency distribution of an object, in particular for training and/or research purposes and/or for medical applications as described herein.

According to the invention, magnetorheological materials, in particular MRFS, are hence proposed which contain a combination of magnetic and non-magnetic inorganic materials and/or composite particles thereof.

There are understood as combination of magnetic and non-magnetic inorganic materials in the sense of the invention, all the magnetic and non-magnetic inorganic materials which are interrelated. This can hereby concern interactions, such as e.g. van der Waals interactions or electromagnetic interactions, which can lead to enveloping of the core.

In the case of the non-magnetic inorganic materials, in particular those comprising anisometric particles such as flakes or rods are preferred. Examples of these are flake-like laminar silicates, such as e.g. mica. In the case of the magnetic materials, all those magnetic materials which are known from the state of the art are possible, in particular in the form of inorganic particles. An example of this is magnetite. The average particle size of the non-magnetic materials can be between 0.005 and 1000 μm, preferably between 0.01 and 200 μm. The volume ratio of the magnetic and non-magnetic materials relative to each other is between 1:99 and 99:1, preferably 10:90 and 90:10.

There are understood by composite particles in the sense of the invention, discrete particles which comprise both magnetic and non-magnetic materials. In the case of composite particles, those are preferred which have anisometric non-magnetic organic particles as core, such as e.g. flakes or rods which are covered with a shell of a magnetic material. The shell can thereby cover the core entirely or also merely partially.

A further advantageous embodiment of the magnetorheological materials according to the invention provides that the inorganic particles are at least partly organically modified.

A magnetorheological carrier material with supplements of this type comprising magnetic and non-magnetic inorganic materials has very high stability against sedimentation of the magnetisable particles and at the same time particularly low basic viscosity. Furthermore, exceptionally easy redispersibility is observed. This is expressed in the fact that the sediment formed after a long time can be distributed again in the carrier medium, e.g. in the liquid phase of the MRFs, by an impeller by applying only low force expenditure. In the state of the art, the sediment as a rule has a more solid consistency and hence requires a higher expenditure of force to redisperse the magnetisable particles. Easy redispersibility confers a great advantage in technical application since the magnetorheological materials can be homogenised again more easily in the individual case after a fairly long non-operational state. Otherwise, its efficiency would be restricted by property changes.

A further advantage of the materials according to the invention which contain the supplements according to the invention resides in the fact that an extensive lack of sensitivity to temperature changes is achieved by using inorganic supplements. Inorganic supplements have higher temperature stability than the organic supplements used in commercial materials. In addition, a lower temperature dependency of the stabilisation effect must be taken into account with inorganic supplements in comparison to organic supplements since organic stabilisers comprising polymers can form structures which change with temperature in the carrier medium.

The surprisingly high stabilisation effect of the composite particles against sedimentation of the magnetisable particles in the materials according to the invention is attributed to the formation of particular structures in the carrier medium. One possible explanation is the formation of web-like bonds between the magnetisable particles via the composite particles. The composite particles produce hence bridges between the magnetisable particles and maintain these in suspension. The accumulation of the composite particles on the magnetisable particles is attributed to weak magnetic interactions of the magnetic shell of the composite particles as a result of low magnetic remanence. During shearing of the materials according to the invention in the absence of a magnetic field, the weak bridges are broken with a relatively low force and, when shearing is at an end, can reform. This means that the basic viscosity is relatively low.

With respect to the combination of added magnetic and non-magnetic particles, it assumed that the magnetic inorganic particles at least partially envelope the non-magnetic particles and "composite particles" comprising both types are produced in this way and, for their part, construct stable structures between the magnetisable particles.

The production of discrete composite particles is effected preferably by preceding coating of the non-magnetic inorganic particles with magnetic material. The coating can be produced by the accumulation of smaller magnetic particles on larger non-magnetic inorganic substrate particles. The coating can be formed also by the separate addition of larger non-magnetic inorganic particles and smaller magnetic particles in the carrier medium so that composite particles are consequently produced.

A preferred form of the core is an anisometric form, such as e.g. flakes or rods. Flake-shaped laminar silicates, such as e.g. mica, constitute one example. The smaller magnetic particles, such as e.g. magnetite, cover the surface of the non-magnetic inorganic particles.

A further advantageous embodiment of the magnetorheological materials according to the invention with respect to the composite particles provides that the average particle size of the composite particles is between 0.005 and 1000 μm, preferably between 0.01 μm and 200 μm. It has been shown furthermore that it is favourable if the volume ratio of the magnetic and non-magnetic inorganic components of the composite particle is between 1:99 and 99:1, preferably between 10:90 and 90:10.

The magnetisable particles can be formed from soft magnetic particles according to the state of the art. This means that the magnetisable particles can be selected both from the quantity of soft magnetic metallic materials, such as iron, cobalt, nickel (also in non-pure form) and alloys thereof, such as iron-cobalt, iron-nickel; magnetic steel; iron-silicon and from the quantity of soft magnetic oxide-ceramic materials, such as cubic ferrites, of the general formulas $$MO.Fe_2O_3$$

with one or more metals from the group M=Mn, Fe, Co, Ni, Cu, Zn, Ti, Cd or Mg; perovskites of the general formula $$3A_2O_3.3Fe_2O_3 \text{ or } A^{3+}Mn^{3+}O_3.Me^{2+}Mn^{4+}O_3,$$

wherein A is a trivalent rare earth element and Me is selected from Ca, Sr, Pb, Cd, and Ba; and garnets of the general formula $$M_3B_5O_{12},$$

wherein M is a rare earth element and B is iron or iron doped with Al, Ga, Sc or Cr. In addition however also mixed ferrites, such as MnZn-, NiZn-, NiCo-, NiCuCo-, NiMg-, CuMg-ferrite can also be used.

The magnetisable particles can however also comprise iron carbide or iron nitride particles or alloys of vanadium, tungsten, copper and manganese or mixtures of the mentioned particle materials or mixtures of different magnetisable types of solids. The soft magnetic materials can thereby also be present in total or in part in unpurified form.

According to the invention, the carrier medium of the magnetorheological materials can comprise carrier fluids according to the state of the art, such as water, mineral oils, synthetic oils such as polyalphaolefins, hydrocarbons, silicone oils, esters, polyethers, fluorinated polyethers, polyglycols, fluorinated hydrocarbons, halogenated hydrocarbons, fluorinated silicones, organically modified silicones and also copolymers thereof or fluid mixtures.

Particular embodiments provide that the carrier medium of the magnetorheological materials comprises fats or gels or elastomers.

In an advantageous embodiment of the magnetorheological materials according to the invention, further inorganic particles, such as $SiO_2$, $TiO_2$, iron oxides, silicates, such as e.g. laminar silicates or organic additives and also combinations thereof, are added to the suspension.

It is also possible to add particulate additives, such as graphite, perfluoroethylene or molybdenum compounds, such as molybdenum disulphite and also combinations thereof, to the magnetorheological materials in order to reduce abrasion phenomena. Alternative embodiments of the magnetorheological materials provide furthermore that the suspension to be used for the surface treatment of workpieces contains specially abrasively acting and/or chemically etching supplements, such as e.g. aluminium oxide, (e.g., corundum),cerium oxide, silicon carbide or diamond.

It has proved overall to be advantageous if the proportion of the magnetisable particles is between 10 and 70% by volume, preferably between 20 and 60% by volume; the proportion of the carrier medium is between 20 and 90% by volume, preferably between 30 and 80% by volume, the total proportion of the combination of magnetic and non-magnetic supplements and/or composite particles is between 0.1 and 20% by mass, preferably between 0.2 and 15% by mass and the proportion of non-magnetisable additives is between 0.001 and 20% by mass, preferably between 0.01 and 15% by mass (respectively relative to the magnetisable solids).

The invention relates furthermore to the use of the materials according to the invention.

An advantageous embodiment of the magnetorheological materials according to the invention provides use thereof in adaptive shock and vibration dampers, controllable brakes, clutches and also in sports or training appliances. Special materials can also be used for surface machining of workpieces.

Finally the magnetorheological materials can also be used to generate and/or to display haptic information, such as characters, computer-simulated objects, sensor signals or images, in haptic form, in order to simulate viscose, elastic and/or visco-elastic properties or the consistency distribution of an object, in particular for training and/or research purposes and/or for medical applications.

The invention is explained in more detail by the subsequent examples and comparative examples.

EXAMPLE 1

MRF 3 according to the invention using mica flakes coated with nanoscale magnetite In order to produce 80 ml of an MRF 3 according to the invention with 35% by volume iron in polyalphaolefin, the procedure takes place as follows:

41.6 g polyalphaolefin (density 0.8 g/cm$^3$ at 15° C., kinematic viscosity 5 mm/s$^2$ at 40° C.) are weighed out in a steel container of 250 ml volume to 0.001 g weighing accuracy. 0.044 g of the dispersion agent lecithin are added and dissolved with heating. Subsequently, 4.409 g mica flakes with an average size of 1 μm and coated with nanoscale magnetite are dispersed therein with a high speed agitator (Ultraturrax, company IKA Laboratory Technology) for 3 min. at 9500 rpm.

Finally, carbonyl iron powder of the company BASF with an average particle size of 4.7 μm (measured in isopropanol by means of laser diffraction with the help of a Mastersizer S of the company Malvern Instruments) are added as magnetisable material. The dispersion of the iron powder in the oil mixture is effected with the help of an agitator (Dispermat, company VMA-Getzmann GmbHl) by means of a dissolver disc (diameter 30 mm). The solid is sprinkled into this slowly with constant agitation and the agitation speed is slowly increased. The spacing between the dissolver disc and the container base is thereby 1 mm. The treatment duration is 3 min. at a speed of rotation of 5000 rpm. The optimum agitation speed is achieved in the Dispermat when the rotating disc is visible from the top by forming a waterspout.

EXAMPLE 2

MRF 4 according to the invention using a bentonite/magnetite supplement

In order to produce 80 ml of an MRF 4 according to the invention with 35% by volume iron in polyalphaolefin, the procedure takes place as follows:

41.6 g polyalphaolefin (density 0.8 g/cm$^3$ at 15° C., kinematic viscosity 5 mm/s$^2$ at 40° C.) are weighed out in a steel container of 250 ml volume to 0.001 g weighing accuracy. 0.044 g of the dispersion agent lecithin are added and dissolved with heating. Subsequently, 4.409 g hydrophobic bentonite are dispersed therein with a high speed agitator (Ultraturrax, company IKA Laboratory Technology) for 3 min. at 9500 rpm per minute. The addition of 4.409 g nanoscale magnetite is effected analogously.

Finally, 220.47 g carbonyl iron powder of the company BASF with an average particle size of 4.7 μm (measured in isopropanol by means of laser diffraction with the help of a Mastersizer S of the company Malvern Instruments) are added as magnetisable material. The dispersion of the iron powder in the oil mixture is effected as described in example 1.

COMPARATIVE EXAMPLE 1

MRF 1 without the addition of a sedimentation stabiliser

In order to produce 80 ml of a suspension with 35% by volume iron in polyalphaolefin, the procedure takes place as follows:

41.6 g polyalphaolefin (density 0.8 g/cm$^3$ at 15° C., kinematic viscosity 5 mm/s$^2$ at 40° C.) are weighed out in a steel container of 250 ml volume to 0.001 g weighing accuracy. 0.044 g of the dispersion agent lecithin are added and dissolved with heating. Finally, 220.47 g carbonyl iron powder of the company BASF with an average particle size of 4,7 μm (measured in isopropanol by means of laser diffraction with the help of a Mastersizer S of the company Malvern Instruments) are added as magnetisable material. The dispersion of the iron powder in the oil mixture is effected as described in example 1.

COMPARATIVE EXAMPLE 2

MRF 2 using a supplement of lithium grease as sedimentation stabiliser

In order to produce 80 ml of a suspension with 35% by volume iron in polyalphaolefin, the procedure takes place as follows:

41.6 g polyalphaolefin (density 0.8 g/cm$^3$ at 15C., kinematic viscosity 5 mm/s$^2$ at 40° C.) are weighed out in a steel container of 250 ml volume to 0.001 g weighing accuracy. 0.044 g of the dispersion agent lecithin are added and dissolved with heating. Subsequently 8.39 g lithium grease NLGI 2 are agitated therein with a high speed agitator (Ultraturrax, company IKA Laboratory Technology) for 3 min. at 9500 rpm. Finally, 220.47 g carbonyl iron powder of the company BASF with an average particle size of 4.7 μm (measured in isopropanol by means of laser diffraction with the help of a Mastersizer S of the company Malvern Instruments) are added as magnetisable material. The dispersion of the iron powder in the oil mixture is effected as described in example 1.

Experiments for characterising the thus produced magnetorheological fluids are described subsequently.

Sedimentation analysis

The sedimentation analysis was effected in glass tubes (total height 160 mm, internal diameter 14.1 mm, wall thickness 0.8 mm) at 25° C. The phase boundary between the sediment and the supernatant was recorded visually at defined time intervals. Subsequently the height of the deposited solid relative to the total height of the MRF sample is thereby termed as "sediment level" [%]. The results are represented in FIG. 1.

It is detected that both MRF 3 and MRF 4 according to the invention have an extremely low phase separation within the first observation stage and remain stable subsequently for 60 days without sedimentation progressing. Even after 60 days, the sediment level is still at >97%. In contrast, the two comparative suspensions MRF 1 and MRF 2 according to the state of the art sediment to a very much greater extent and still only have sediment levels of approx. 73 or 90% even after a few days.

Tests for the redispersibility of the MRFs ("spatula test")

With the lack of a standard test for characterising the redispersion behaviour of an MRF, the suspensions in the present case were subjected to comparative qualitative assessment.

For this purpose, firstly respectively 5 ml MRF were centrifuged for 15 min. at 130 g and subsequently the relative sedimentation levels of the solid proportions were determined. Subsequently the consistency of the solid proportions was determined subjectively by means of the resistance to be overcome by introducing a thin spatula and slow rotation.

The consistencies of the solid proportions determined in this manner were classified phenomenologically by "soft" via "medium soft", "medium" up to "medium hard" and "hard" and correlated with an "excellent" or "very poor" redispersion behaviour. The results are compiled in the subsequent table.

TABLE

Qualitative assessment of the redispersion behaviour of the tested MRF(s)

| Suspension | Sediment level [%] | Consistency | Redispersibility |
|---|---|---|---|
| MRF 1 | 64 | medium soft | good |
| MRF 2 | 66 | medium hard | average |
| MRF 3 | 74.5 | soft | excellent |
| MRF 4 | 74.5 | soft | excellent |

It is detected that both MRF 3 and MRF 4 according to the invention deliver significantly better results both with respect to the sedimentation level and with respect to the redispersion behaviour than the two comparative dispersions MRF 1 and MRF 2.

Dependency of the shear stress upon the shear rate without an applied magnetic field The rheological measurements were effected in a rotational rheometer (Searle System) MCR 300 of the company Paar Physica in a measuring system with coaxial cylinder geometry at 25° C. The results are represented in FIG. 2.

It is thereby shown that the flow curves of both MRF 3 and MRF 4 according to the invention are practically congruent and have a maximum shear stress of 150 Pa at a shear rate of 1000 s$^{-1.}$ The corresponding shear stresses of MRF 1 and MRF 2 according to the state of the art are approx. 70 or 200 Pa. Hence MRF 1 has the lowest and MRF 2 the highest basic viscosity in the magnetic field-free space, whereas both MRF 3 and MRF 4 according to the invention occupy a central position.

Together with their exceptional sedimentation stability, the two suspensions MRF 3 and MRF 4 according to the invention hence have an outstanding property profile such that they are predestined for use as magnetorheological fluids.

Dependency of the shear stress upon the magnetic flux density

The magnetorheological measurements were effected in a rotational rheometer (Searle System) MCR 300 of the company Paar Physica in a plate-plate arrangement, the magnetic field extending perpendicularly to the plates. All the tests were implemented at 25° C. and at a constant shear rate of 100 s$^{-1}$. The results are represented in FIG. 3.

It is detected that both MRF 3 and MRF 4 according to the invention have a significantly higher shear stress above a magnetic flux density of approx. 200 mT than both magnetorheological fluids MRF 1 and MRF 2 according to the state of the art. In practice, high shear stresses in the applied magnetic field are desired since they effect an effective conversion of a magnetic excitation into a rheological change in the MRF. Hence both MRF 3 and MRF 4 according to the invention have a further advantageous property for use as magnetorheological fluids.

Dependency of the dynamic viscosity upon the temperature

The rheological measurements were effected in a rotational rheometer (Searle System) MCR 300 of the company Paar Physica in a ball-plate arrangement at a constant shear rate of 100 $s^{-1}$ in the temperature range of −15 to +120° C. At temperatures below 25° C. argon flushing took place in order to avoid condensed water formation. The viscosity-temperature dependency was evaluated according to the Vogel-Cameron equation (V-C equation) [Kulicke, W. −M.; Flow behaviour of materials and material mixtures, 1986, Huthig Wepf Press, Heidelberg, page 123]:

$$-\ln\eta = \frac{B}{T[^\circ C.] + C} + A$$

η is thereby the dynamic temperature-dependent viscosity and A and B are material constants; C=95° C. for mineral oils if the temperature is indicated in ° C.

The results are represented in FIG. 4. It is detected that the compensating straight lines for both MRF 3 and MRF 4 according to the invention are practically congruent and have a lower rise in the V-C plot than both magnetorheological fluids according to the state of the art, MRF 1 and MRF 2. From the lower linear rise for MRF 3 and MRF 4 there follows a lower temperature dependency of both MRFs according to the invention relative to the state of the art which can be regarded as a further advantage.

In total, it remains to be stressed that MRF3 and MRF 4 according to the invention with magnetic and non-magnetic inorganic supplements in comparison to magnetorheological fluids according to the state of the art confer crucial advantages with respect to the property combination, sedimentation stability, redispersibility, basic viscosity, shear stress in the magnetic field and viscosity/temperature dependency.

BRIEF DESCRIPTION OF THE DRAWINGS

FIG. 1 shows the sedimentation course 25° C. as a function of time for MRF 1, MRF 2, MRF 3 and MRF 4.

FIG. 2 shows the dependency of the shear stress upon the shear rate (flow curves at 25° C.) without an applied magnetic field for MRF 1, MRF 2, MRF 3 and MRF 4.

FIG. 3 shows the dependency of the shear stress upon the magnetic flux density at a shear rate of 100 $s^{-1}$ and 25° C. for MRF 1, MRF 2 MRF 3 and MRF 4.

FIG. 4 shows the dependency of the dynamic viscosity as a function of temperature (Vogel-Cameron plotting) at a shear rate of 100 $s^{-1}$ for MRF 1, MRF 2, MRF 3 and MRF 4.

The invention claimed is:

1. A magnetorheological material comprising at least one non-magnetisable carrier medium, magnetisable particles contained therein, one or more additives, and a combination of magnetic and non-magnetic inorganic materials and/or composite particles thereof, wherein the magnetisable particles are present in the material in an amount between 10 and 70% by volume, the carrier medium is present in the material in an amount between 20 and 90% by volume, the combination of magnetic and non-magnetic materials and/or composite particles is present in the material in an amount between 0.1 and 20% by mass (relative to the magnetisable solids), and the additives are present in the material in an amount between 0.001 and 20% by mass (relative to the magnetisable solids).

2. A magnetorheological material according to claim 1, wherein the non-magnetic inorganic materials are anisometric particles.

3. A magnetorheological material according to claim 2, wherein the anisometric particles comprise flake-shaped laminar silicates.

4. A magnetorheological material according to claim 1, wherein the average particle size of the non-magnetic inorganic materials is between 0.005 and 1000 μm.

5. A magnetorheological material according to claim 1, wherein the volume ratio of the magnetic and non-magnetic inorganic materials relative to each other is between 1:99 and 99:1.

6. A magnetorheological material according to claim 1, wherein the magnetic materials comprise inorganic particles.

7. A magnetorheological material according to claim 6, wherein the inorganic particles are modified organically at least in part.

8. A magnetorheological material according to claim 1, wherein the composite particles contain a non-magnetic core and a magnetic shell.

9. A magnetorheological material according to claim 1, wherein the composite particles have an anisometric form.

10. A magnetorheological material according to claim 1, wherein the composite particles were formed in the carrier medium.

11. A magnetorheological material according to claim 1, wherein the average particle size of the composite particles is between 0.005 and 1000 μm.

12. A magnetorheological material according to claim 1, wherein the volume ratio of the magnetic and non-magnetic inorganic component of the composite particles is between 1:99 and 99:1.

13. A magnetorheological material according to claim 1, wherein the magnetisable particles are soft magnetic materials.

14. A magnetorheological material according to claim 13, wherein the magnetisable particles are soft magnetic metallic materials.

15. A magnetorheological material according to claim 14, wherein the soft magnetic metallic materials are selected from iron, cobalt, nickel, alloys thereof, magnetic steel, iron-silicon, and a mixture thereof.

16. A magnetorheological material according to claim 13, wherein the magnetisable particles are soft magnetic oxide-ceramic materials.

17. A magnetorheological material according to claim 16, wherein the soft magnetic oxide-ceramic material is selected from cubic ferrites, perovskites and garnets and mixtures thereof.

18. A magnetorheological material according to claim 17, wherein the cubic ferrite is of the general formula $$MO.Fe_2O_3$$

with one or more metals from the group M=Mn, Fe, Co, Ni, Cu, Zn, Ti, Cd or Mg.

19. A magnetorheological material according to claim 17, wherein the perovskite is of the general formula $3A_2O_3.3Fe_2O_3$ or $A^{3+}Mn^{3+}O_3.Me^{2+}Mn^{4+}O_3$, wherein A is a trivalent rare earth element and Me is selected from Ca, Sr, Pb, Cd, and Ba.

20. A magnetorheological material according to claim 17, wherein the garnet is of the general formula $M_3B_5O_{12}$, wherein M is a rare earth element and B is iron or iron doped with Al, Ga, Sc or Cr.

21. A magnetorheological material according to claim 13, wherein the magnetisable particles are mixed ferrites.

22. A magnetorheological material according to claim 21, wherein the mixed ferrite is selected from MnZn—, NiZn—, NiCo—, NiCuCo—, NiMg—, CuMg—ferrites and mixtures thereof.

23. A magnetorheological material according to claim 13, wherein the magnetisable particles are selected from iron carbide, iron nitride, alloys of vanadium, tungsten, copper and manganese, and mixtures thereof.

24. A magnetorheological material according to claim 1, wherein the carrier medium is selected from a carrier fluid selected from water, mineral oils, synthetic oils, polyalphaolefins, hydrocarbons, silicone oils, esters, polyethers, fluorinated polyethers, polyglycols, fluorinated hydrocarbons, halogenated hydrocarbons, fluorinated silicones, organically modified silicones, copolymers thereof, and fluid mixtures thereof, a fat or gel; or an elastomer.

25. A magnetorheological material according to claim 1, further containing additives selected from dispersion agents, antioxidants, defoamers and anti-abrasion means.

26. A magnetorheological material according to claim 1, further containing additives that reduce abrasion phenomena, particulate supplements perfluoroethylene compounds, molybdenum compounds, and combinations thereof.

27. A magnetorheological material according to claim 1, further comprising abrasively acting and/or chemically etching supplements.

28. A magnetorheological material according to claim 27, wherein the abrasively acting and/or chemically etching supplements are selected from aluminium oxide, cerium oxide, silicon carbide and diamond.

29. A magnetorheological material according to claim 1, wherein the magnetisable particles are present in the material in an amount between 20 and 60% by volume, the carrier medium is present in the material in an amount between 30 and 80% by volume, the combination of magnetic and non-magnetic materials and/or composite particles is present in the material in an amount between 0.2 and 15% by mass (relative to the magnetisable solids), the proportion of additives is are present in the material in an amount between 0.01 and 15% by mass (relative to the magnetisable solids).

* * * * *